US010825376B2

(12) United States Patent
Yim et al.

(10) Patent No.: US 10,825,376 B2
(45) Date of Patent: Nov. 3, 2020

(54) DISPLAY DEVICE AND DRIVING METHOD THEREOF

(71) Applicant: SAMSUNG DISPLAY CO., LTD., Yongin-Si, Gyeonggi-Do (KR)

(72) Inventors: Dale Yim, Yongin-si (KR); Takeshi Kato, Yongin-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 0 days.

(21) Appl. No.: 16/508,811

(22) Filed: Jul. 11, 2019

(65) Prior Publication Data

US 2020/0234626 A1 Jul. 23, 2020

(30) Foreign Application Priority Data

Jan. 21, 2019 (KR) ..... 10-2019-0007544

(51) Int. Cl.
*G09G 3/20* (2006.01)
*G09G 3/32* (2016.01)

(52) U.S. Cl.
CPC ..... *G09G 3/2011* (2013.01); *G09G 3/2003* (2013.01); *G09G 3/32* (2013.01);
(Continued)

(58) Field of Classification Search
CPC ..... G09G 2340/06; G09G 5/02; G09G 5/026; G09G 5/06; G09G 2320/0666; G09G 2320/0276; G09G 2320/0242; G09G 2320/0693; G09G 3/2003; G09G 3/3208; H04N 1/6058; H04N 1/00023; H04N 1/6008; H04N 1/6027; H04N 1/60; H04N 9/3182; H04N 9/68; H04N 9/643
See application file for complete search history.

(56) References Cited

U.S. PATENT DOCUMENTS 9,710,932 B2 7/2017 Park et al.
9,721,533 B2 8/2017 Cho et al.
(Continued)

FOREIGN PATENT DOCUMENTS

KR 10-2015-0098976 8/2015
KR 10-2017-0005953 1/2017
KR 10-2019-0073633 6/2019

*Primary Examiner* — Dong Hui Liang
(74) *Attorney, Agent, or Firm* — F. Chau & Associates, LLC

(57) ABSTRACT

A display device and driving method thereof are disclosed. The display device includes a pixel emitting light at a luminance corresponding to an output grayscale value and a color shifter for converting an input grayscale value into the output grayscale value based on output color gamut information. The color shifter includes an offset storage unit storing reference color gamut information and offset information; and a color gamut determination unit that determines the output color gamut information using the reference color gamut information and the offset information when the color shift level corresponds to a value between the reference level and the shift levels, and determines tire output color gamut information using second offset information in which the offset information is inverted and the reference color gamut information when the color shift level is not between the reference level and the shift levels.

15 Claims, 10 Drawing Sheets

(52) U.S. Cl.
CPC ..... *G09G 2320/0276* (2013.01); *G09G 2320/0666* (2013.01); *G09G 2320/0673* (2013.01)

(56) References Cited

U.S. PATENT DOCUMENTS

| | | | | |
|---|---|---|---|---|
| 10,002,577 | B2 | 6/2018 | Liu et al. | |
| 2004/0178743 | A1* | 9/2004 | Miller | G09G 3/3216 315/169.3 |
| 2005/0152597 | A1* | 7/2005 | Spaulding | H04N 1/6058 382/162 |
| 2019/0189079 | A1 | 6/2019 | Seo et al. | |

* cited by examiner

FIG. 7

LV0

| | R | G | B |
|---|---|---|---|
| R | 255 | 0 | 0 |
| G | 0 | 255 | 0 |
| B | 0 | 0 | 255 |
| C | 0 | 255 | 255 |
| M | 255 | 0 | 255 |
| Y | 255 | 255 | 0 |
| W | 255 | 255 | 255 |

OF1

| | | |
|---|---|---|
| -19 | 0 | 0 |
| 16 | -41 | 0 |
| 3 | 0 | -101 |
| 19 | -41 | -101 |
| -16 | 0 | -101 |
| -3 | -41 | 0 |
| 0 | -41 | -101 |

LV1

| | R | G | B |
|---|---|---|---|
| R | 236 | 0 | 0 |
| G | 16 | 214 | 0 |
| B | 3 | 0 | 154 |
| C | 19 | 214 | 154 |
| M | 239 | 0 | 154 |
| Y | 252 | 214 | 0 |
| W | 255 | 214 | 154 |

OF2

| | | |
|---|---|---|
| -23 | 0 | 0 |
| 21 | -51 | 0 |
| 3 | 0 | -80 |
| 23 | -51 | -80 |
| -21 | 0 | -80 |
| -3 | -51 | 0 |
| 0 | -51 | -80 |

LV2

| | R | G | B |
|---|---|---|---|
| R | 213 | 0 | 0 |
| G | 37 | 163 | 0 |
| B | 6 | 0 | 74 |
| C | 42 | 163 | 74 |
| M | 218 | 0 | 74 |
| Y | 249 | 163 | 0 |
| W | 255 | 163 | 74 |

OF3

| | | |
|---|---|---|
| -25 | 0 | 0 |
| 23 | -57 | 0 |
| 0 | 0 | -50 |
| 24 | -57 | -50 |
| -24 | 0 | -50 |
| 0 | -57 | 0 |
| 0 | -57 | -50 |

LV3

| | R | G | B |
|---|---|---|---|
| R | 188 | 0 | 0 |
| G | 60 | 106 | 0 |
| B | 6 | 0 | 24 |
| C | 66 | 106 | 24 |
| M | 194 | 0 | 24 |
| Y | 249 | 106 | 0 |
| W | 255 | 106 | 24 |

FIG. 8

LVI_CS

| | | | | |
|---|---|---|---|---|
| LVI_R=[246,0,0] | | LVO_R=[255,0,0] | | OFI_R=[-9,0,0] |
| LVI_G=[ 8,235,0] | | LVO_G=[0,255,0] | | OFI_G=[ 8,-20,0] |
| LVI_B=[ 1,0,205] | | LVO_B=[0,0,255] | | OFI_B=[ 1,0,-50] |
| LVI_C=[ 9,235,205] | = | LVO_C=[0,255,255] | + | OFI_C=[ 9,-20,-50] |
| LVI_M=[247,0,205] | | LVO_M=[255,0,255] | | OFI_M=[-8,0,-50] |
| LVI_Y=[254,235,0] | | LVO_Y=[255,255,0] | | OFI_Y=[-1 ,-20,0] |
| LVI_W=[255,235,205] | | LVO_W=[255,255,255] | | OFI_W=[0,-20,-50] |

FIG. 9

IOF1_R=[ 19,0,0]
IOF1_G=[-16,41,0]
IOF1_B=[-3,0,101]
IOF1_C=[-19,41,101]
IOF1_M=[ 16,0,101]
IOF1_Y=[ 3,41,0]
IOF1_W=[0,41,101]

IOF2_R=[ 23,0,0]
IOF2_G=[-21,51,0]
IOF2_B=[-3,0,80]
IOF2_C=[-23,51,80]
IOF2_M=[ 21,0,80]
IOF2_Y=[ 3,51,0]
IOF2_W=[0,51,80]

IOF3_R=[ 25,0,0]
IOF3_G=[-23,57,0]
IOF3_B=[0,0,50]
IOF3_C=[-24,57,50]
IOF3_M=[ 24,0,50]
IOF3_Y=[0,57,0]
IOF3_W=[0,57,50]

LVI_CS

| | | | | |
|---|---|---|---|---|
| LVI_R=[206,0,0] | | LVO_R=[255,0,0] | | IOFI_R=[-49,0,0] |
| LVI_G=[ 44,147,0] | | LVO_G=[0,255,0] | | IOFI_G=[ 44,-108,0] |
| LVI_B=[ 6,0,60] | | LVO_B=[0,0,255] | | IOFI_B=[ 6,0,-195] |
| LVI_C=[ 49,147,60] | = | LVO_C=[0,255,255] | + | IOFI_C=[ 49,-108,-195] |
| LVI_M=[211,0,60] | | LVO_M=[255,0,255] | | IOFI_M=[-44,0,-195] |
| LVI_Y=[249,147,0] | | LVO_Y=[255,255,0] | | IOFI_Y=[-6,-108,0] |
| LVI_W=[255,147,60] | | LVO_W=[255,255,255] | | IOFI_W=[0,-108,-195] |

| Case | condition | C1 | C2 | C3 |
|---|---|---|---|---|
| A1 | RG>GG>BG | LVI_R-LVI_K | LVI_C-LVI_B | LVI_W-LVI_Y |
| A2 | RG>BG>GG | LVI_R-LVI_K | LVI_W-LVI_M | LVI_M-LVI_R |
| A3 | BG>RG>GG | LVI_M-LVI_B | LVI_W-LVI_M | LVI_B-LVI_K |
| A4 | GG>RG>BG | LVI_Y-LVI_G | LVI_G-LVI_K | LVI_W-LVI_Y |
| A5 | GG>BG>RG | LVI_W-LVI_C | LVI_G-LVI_K | LVI_C-LVI_G |
| A6 | BG>GG>RG | LVI_W-LVI_C | LVI_C-LVI_B | LVI_B-LVI_K |

DISPLAY DEVICE AND DRIVING METHOD THEREOF

CROSS-REFERENCE TO RELATED APPLICATION

The application claims priority from and the benefit of Korean Patent Application No. 10-2019-0007544, filed Jan. 21, 2019, which is hereby incorporated by reference herein for all purposes as if fully set forth.

BACKGROUND

Field

Exemplary embodiments relate to a display device and a driving method thereof.

Discussion

With the development of information technology, the importance of display devices, which are a connection medium between users and information, has been emphasized. In response to this, the use of display devices such as liquid crystal display devices, organic light emitting display devices, and plasma display devices has been increasing.

The color gamut of a display device refers to the range of colors that are available on the device. The color gamut in a display device may be controlled by a user's setting or other control signals.

SUMMARY

A technical problem to be solved is to provide a display device and a driving method thereof capable of controlling a color gamut using minimum information.

According to one exemplary embodiment, a display device may include: a pixel emitting light at a luminance corresponding to an output grayscale value; and a color shifter for converting an input grayscale value into the output grayscale value based on output color gamut information determined according to a color shift level, wherein the color shifter includes: an offset storage unit in which reference color gamut information corresponding to a reference level and first offset information corresponding to first shift levels are stored; and a color gamut determination unit that determines the output color gamut information using the reference color gamut information and the first offset information when the color shift level corresponds to a value between the reference level and the first shift levels, and determines the output color gamut information using second offset information in which the first offset information is inverted and the reference color gamut information when the color shift level is not between the reference level and the first shift levels.

The color shifter may further include an offset inversion calculation unit for inverting the first offset information to generate the second offset information when the color shift level is not between the reference level and the first shift levels.

The color shifter may further include a gamma application unit for applying a gamma curve to the input grayscale value to generate a gamma grayscale value.

The color shifter may further include a color gamut application unit for applying the output color gamut information to the gamma grayscale value to generate a corrected grayscale value.

The color shifter may further include an inverse gamma application unit for applying an inverse gamma curve to the corrected grayscale value to generate the output grayscale value.

When the color shift level corresponds to the value between the reference level and the first shift levels, a ratio of a blue color area of an output color gamut of the output color gamut information may be smaller than that of a reference color gamut of the reference color gamut information.

When the color shift level corresponds to a value between the reference level and second shift levels, a ratio of a red color area of the output color gamut of the output color gamut information may be smaller than that of the reference color gamut of the reference color gamut information.

According to one exemplary embodiment, a driving method of a display device may include: determining output color gamut information according to a color shift level; converting an input grayscale value into an output grayscale value based on the output color gamut information; and emitting, by a pixel, light at a luminance corresponding to the output grayscale value, wherein the determining the output color gamut information comprises: determining the output color gamut information using reference color gamut information corresponding to a reference level and first offset information corresponding to first shift levels when the color shift level corresponds to a value between the reference level and the first shift levels, and determining the output color gamut information using second offset information in which the first offset information is inverted and the reference color gamut information when the color shift level is not between the reference level and the first shift levels.

The reference color gamut information and the first offset information may be stored values, and the determining the output color gamut information may comprise: generating the second offset information by inverting the first offset information when the color shift level is not between the reference level and the first shift levels.

The converting the input grayscale value into the output grayscale value may comprise: generating a gamma grayscale value by applying a gamma curve to the input grayscale value.

The converting the input grayscale value into the output grayscale value may further comprise: generating a corrected grayscale value by applying the output color gamut information to the gamma grayscale value.

The converting the input grayscale value into the output grayscale value may further comprise: generating the output grayscale value by applying an inverse gamma curve to the corrected grayscale value.

When the color shift level corresponds to the value between the reference level and the first shift levels, a ratio of a blue color area of an output color gamut of the output color gamut information may be smaller than that of a reference color gamut of the reference color gamut information.

When the color shift level corresponds to a value between the reference level and second shift levels, a ratio of a red color area of the output color gamut of the output color gamut information may be smaller than that of the reference color gamut of the reference color gamut information.

According to another exemplary embodiment, a display device may determine whether a color shift level has a negative value; select first offset information or inverted first offset information based on the determination; generate output color gamut information based on the selected first offset information or inverted first offset information; convert an input grayscale value to an output grayscale value based on the generated output color gamut information; and emit light at a pixel based on the output grayscale value.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

FIGS. 6 to 8 are diagrams for explaining output color gamut information when a color shift level corresponds to a value between a reference level and first shift levels.

FIGS. 9 and 10 are diagrams for explaining output color gamut information when a color shift level corresponds to a value between a reference level and second shift levels.

FIG. 11 is a graph for explaining a gamma application unit according to an embodiment of the invention.

DETAILED DESCRIPTION OF THE ILLUSTRATED EMBODIMENTS

Figure 1:
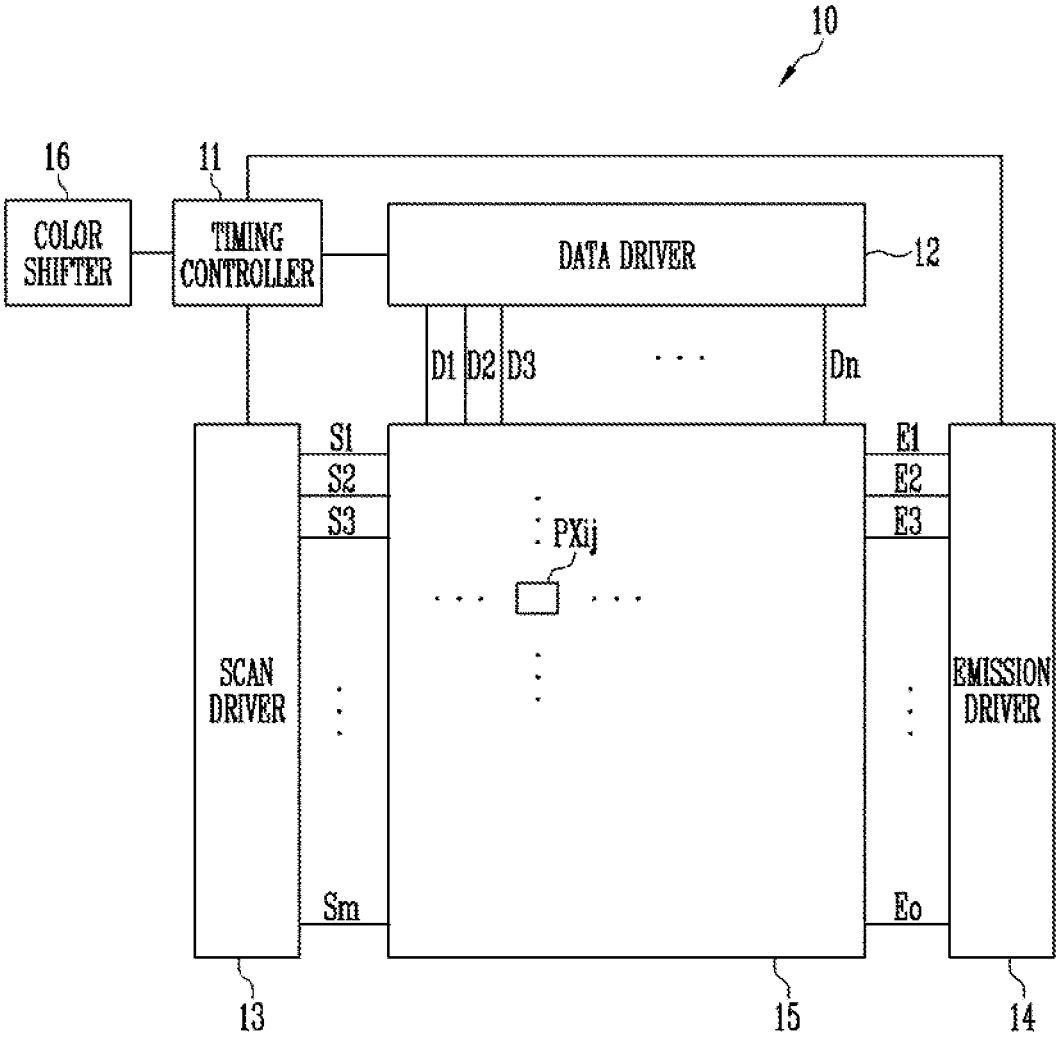
FIG. 1 is a block diagram of a display device according to an embodiment of the invention.

Hereinafter, preferred embodiments of the invention will be described in detail with reference to the accompanying drawings. The following embodiments are provided so that those skilled in the art will be able to fully understand the invention. The embodiments can be modified in various ways. The scope of the invention is not limited to the embodiments described below.

In order to clearly illustrate the invention, parts that are not related to the description are omitted, and the same or similar components are denoted by the same reference numerals throughout the specification. Therefore, the above-mentioned reference numerals can be used in other drawings.

In addition, the size and thickness of each component shown in the drawings are arbitrarily shown for convenience of explanation, and thus the invention is not necessarily limited to those shown in the drawings. In the drawings, thicknesses may be exaggerated for clarity of presentation of layers and regions.

FIG. 1 is a block diagram of a display device according to an embodiment of the invention.

Referring to FIG. 1, a display device 10 according to an embodiment of the invention may include a timing controller 11, a data driver 12, a scan driver 13, an emission driver 14, a pixel unit 15, and a color shifter 16.

The color shifter 16 may convert an input grayscale value into an output grayscale value based on output color gamut information determined according to a color shift level. The color shift level and the input grayscale value may be provided from an external processor.

The timing controller 11 may receive output grayscale values from the color shifter 16 and control signals corresponding to input grayscale values or output grayscale values from an external processor.

The timing controller 11 may convert the output grayscale values and the control signals to conform to the specifications of the data driver 12 and provide them to the data driver 12. Similarly, the timing controller 11 may convert the control signals to conform to the specifications of the scan driver 13 and provide a clock signal, a scan start signal, and the like to the scan driver 13. In addition, the timing controller 11 may convert the control signals to conform to the specifications of the emission driver 14 and provide a clock signal, an emission stop signal, and the like to the emission driver 14.

In some embodiments, the color shifter 16 may be configured with hardware (for example, an integrated circuit) different from the timing controller 11. In some embodiments, the color shifter 16 may be formed integrally with the timing controller 11. In addition, the color shifter 16 may be implemented as software programmed into the timing controller 11.

In the above-described embodiment, the color shifter 16 first receives the input grayscale value, but in another embodiment, the timing controller 11 may first receive the input grayscale value. In this case, the color shifter 16 may generate the output grayscale value using the input grayscale value provided from the timing controller 11.

The data driver 12 may generate data signals to be provided to data lines D1, D2, D3, . . . , Dn using the output grayscale values and the control signals received from the timing controller 11. For example, the data driver 12 may sample the output grayscale values using a clock signal and supply data signals (for example, analog voltages) corresponding to the output grayscale values (e.g., digital values) to the data lines D1 to Dn in units of pixel lines, where n may be an integer greater than 0.

The scan driver 13 may receive the clock signal, the scan start signal, and the like from the timing controller 11 to generate scan signals to be provided to scan lines S1, S2, S3, . . . , Sm, where m may be an integer greater than 0. For example, the scan driver 13 may sequentially supply the scan signals having pulses of a turn-on level to the scan lines S1 to Sm. For example, the scan driver 13 may be configured as a shirt register. The scan driver 13 may generate the scan signals in a manner that sequentially transfers the scan start signal having a pulse of a turn-on level to a next stage circuit under the control of the clock signal.

The emission driver 14 may receive the clock signal, the emission stop signal and the like from the timing controller 11 and generate emission signals to be provided to emission lines E1, E2, E3, . . . , Eo, where o may be an integer greater than 0. For example, the emission driver 14 may sequentially provide the emission signals having pulses of a turn-off level to the emission lines E1 to Eo. For example, the emission driver 14 may be configured as a shift register. The emission driver 14 may generate the emission signals in a manner that sequentially transfers the emission slop signal having a pulse of a turn-off level to a next stage circuit under the control of the clock signal.

The pixel unit 15 may include a plurality of pixels. Each pixel PXij may be connected to a data line, a scan line, and an emission line, where i and j may be integers greater than 0. The pixel PXij may include a scan transistor connected to an i-th scan line and a j-th data line. The pixel PXij may emit light at a luminance corresponding to the output grayscale value. For example, a red pixel may emit light at a luminance corresponding to a red color grayscale value of the output grayscale value, a green pixel may emit light at a luminance corresponding to a green color grayscale value of the output grayscale value, and a blue pixel may emit light at a luminance corresponding to a blue color grayscale value of the output grayscale value. In an exemplary embodiment, three pixels may constitute one dot. In another embodiment, four or more pixels may constitute one dot.

Color shifter 16 may determine whether a color shift level has a negative value; select first offset information or inverted first offset information based on the determination; generate output color gamut information based on the selected first offset information or inverted first offset information; and convert an input grayscale value to an output grayscale value based on the generated output color gamut information. Pixels PXij may then emit light based on the output grayscale value.

The color shift value may be selected in order to affect the mood or mental state of a user. For example, a positive color shift value may correspond to a decrease in blue light (or a relative increase in red light) which may impact the production of melatonin in the user (e.g., it may reduce the degree to which the light inhibits the production of melatonin). This may make it easier for the user to fall asleep after watching the display device 10. On the other hand, a negative color shift value may correspond to a decrease in red light (or a relative increase in blue light) which may result in an increased inhibition of melatonin production, which may improve the mood of the user or mitigate the impact of changing time zones (e.g., reduce jet lag).

Figure 2:
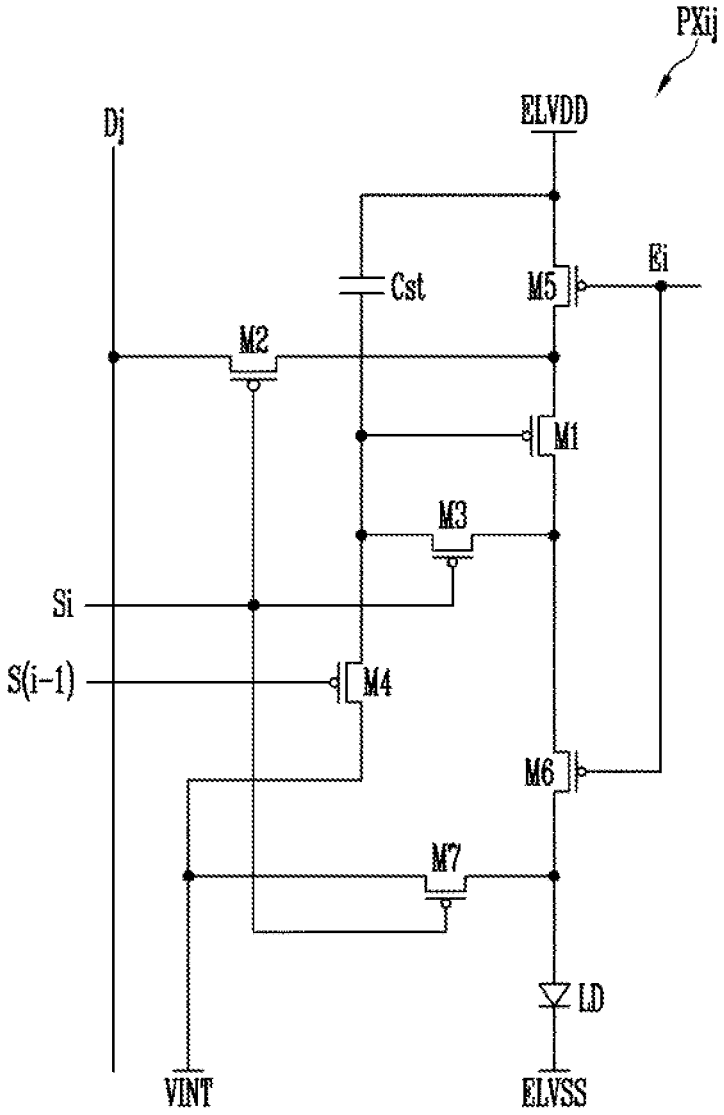
FIG. 2 is a circuit diagram of a diagram of a pixel according to an embodiment of the invention.

FIG. 2 is a circuit diagram of a diagram of a pixel according to an embodiment of the invention.

Referring to FIG. 2, the pixel PXij may include transistors M1, M2, M3, M4, M5, M6, and M7, a storage capacitor Cst, and a light emitting diode LD.

Although the transistors M1 to M7 in this embodiment are shown as P-type transistors (for example, PMOS), those skilled in the art may configure a pixel circuit having the same function as N-type transistors (for example, NMOS).

The storage capacitor Cst may include a first electrode connected to a first power supply line ELVDD and a second electrode connected to a gate electrode of the transistor M1.

The transistor M1 may include a first electrode connected to a second electrode of the transistor M5, a second electrode connected to a first electrode of the transistor M6, and a gate electrode connected to the second electrode of the storage capacitor Cst. The transistor M1 may be referred to as a driving transistor. The transistor M1 may determine the amount of driving current flowing between the first power supply line ELVDD and a second power supply line ELVSS according to a potential difference between the gate electrode and the first electrode (source electrode).

The transistor M2 may include a first electrode connected to a data line Dj, a second electrode connected to the first electrode of the transistor M1, and a gate electrode connected to a current scan line Si. The transistor M2 may be referred to as a scan transistor, a switching transistor, or the like. The transistor M2 may transfer a data signal of the data line Dj to the pixel PXij when a scan signal of a turn-on level is applied to the current scan line Si.

The transistor M3 may include a first electrode connected to the second electrode of the transistor M1, a second electrode connected to the gate electrode of the transistor M1, and a gate electrode connected to the current scan line Si. The transistor M3 may connect the transistor M1 in a diode form when a scan signal of a turn-on level is applied to the current scan line Si.

The transistor M4 may include a first electrode connected to the gate electrode of the transistor M1, a second electrode connected to an initialization voltage line VINT and a gate electrode connected to a previous scan line S(i−1). In another embodiment, the gate electrode of the transistor M4 may be connected to another scan line. The transistor M4 may transfer an initialization voltage to the gate electrode of the transistor M1 so that the amount of charge of the gate electrode of the transistor M1 is initialized when a scan signal of a turn-on level is applied to the previous scan line S(i−1).

The transistor M5 may include a first electrode connected to the first power supply line ELVDD, a second electrode connected to the first electrode of the transistor M1, and a gate electrode connected to an emission line Ei. The transistor M6 may include a first electrode connected to the second electrode of the transistor M1, a second electrode connected to an anode electrode of the light emitting diode LD, and a gate electrode connected to the emission line Ei. The transistors M5 and M6 may be referred to as emission transistors. The transistors M5 and M6 may provide a driving current path between the first power supply line ELVDD and the second power supply line ELVSS to drive the light emitting diode LD when an emission signal of a turn-on level is applied.

The transistor M7 may include a first electrode connected to the anode electrode of the light emitting diode LD, a second electrode connected to the initialization voltage line VINT, and a gate electrode connected to the current scan line Si. In another embodiment, the gate electrode of the transistor M7 may be connected to another scan line. For example, the gate electrode of the transistor M7 may be connected to the previous scan line S(i−1), a further previous scan line S(i−2), a next scan line S(i+1), or a further next scan line S(i+2). The transistor M7 may transfer the initialization voltage to the anode electrode of the light emitting diode LD so that the amount of charge accumulated in the light emitting diode LD is initialized when a scan signal of a turn-on level is applied to the current scan line Si.

The light emitting diode LD may include an anode electrode connected to the second electrode of the transistor M6 and a cathode electrode connected to the second power supply line ELVSS. The light emitting diode LD may be an organic light emitting diode, an inorganic light emitting diode, a quantum dot light emitting diode, or the like.

Figure 3:
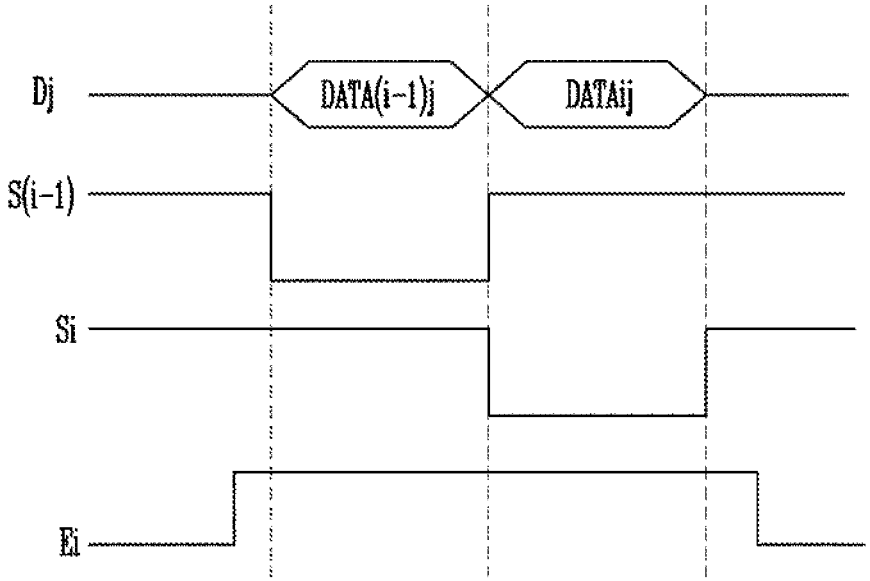
FIG. 3 is a timing chart for explaining a driving method of a pixel according to an embodiment of the invention.

FIG. 3 is a timing chart for explaining a driving method of a pixel according to an embodiment of the invention.

First, a data signal DATA(i−1)j for a previous pixel row may be applied to the data line Dj and a scan signal of a turn-on level (low level) may be applied to the previous scan line S(i−1).

Since the scan signal of the turn-off level (high level) is applied to the current scan line Si, the transistor M2 is turned off and the data signal DATA(i−1)j for the previous pixel row is not transferred to the pixel PXij.

At this time, the transistor M4 is turned on, so the initialization voltage is applied to the gate electrode of the transistor M1 to initialize the amount of charge. Since an emission signal of a turn-off level is applied to the emission line Ei, the transistors M5 and M6 are turned-off, and an unnecessary operation of the light emitting diode LD due to an application of the initialization voltage is prevented.

Next, a data signal DATAij for a current pixel row is applied to the data line Dj, and a scan signal of a turn-on level is applied to the current scan line Si. As a result, the transistors M2, M1, and M3 are turned on, and the data line Dj and the gate electrode of the transistor M1 may be electrically connected. Accordingly, the data signal DATAij is applied to the second electrode of the storage capacitor Cst, and the storage capacitor Cst may accumulate an amount of charge corresponding to a difference between a voltage of the first power supply line ELVDD and the data signal DATAij.

At this time, the transistor M7 is turned on, so the anode electrode of the light emitting diode LD is connected to the initialization voltage line VINT, and the light emitting diode LD is precharged with or initialized to the amount of charge corresponding to a voltage difference between the initialization voltage and a second power supply voltage.

Thereafter, the transistors M5 and M6 are turned on as an emission signal of a turn-on level is applied to the emission line Ei, and the amount of current passing through the transistor M1 may be controlled according to the amount of charge accumulated in the storage capacitor Cst so that a driving current flows to the light emitting diode LD. The light emitting diode LD emits light until an emission signal of a turn-off level is applied to the emission line Ei.

Figure 4:
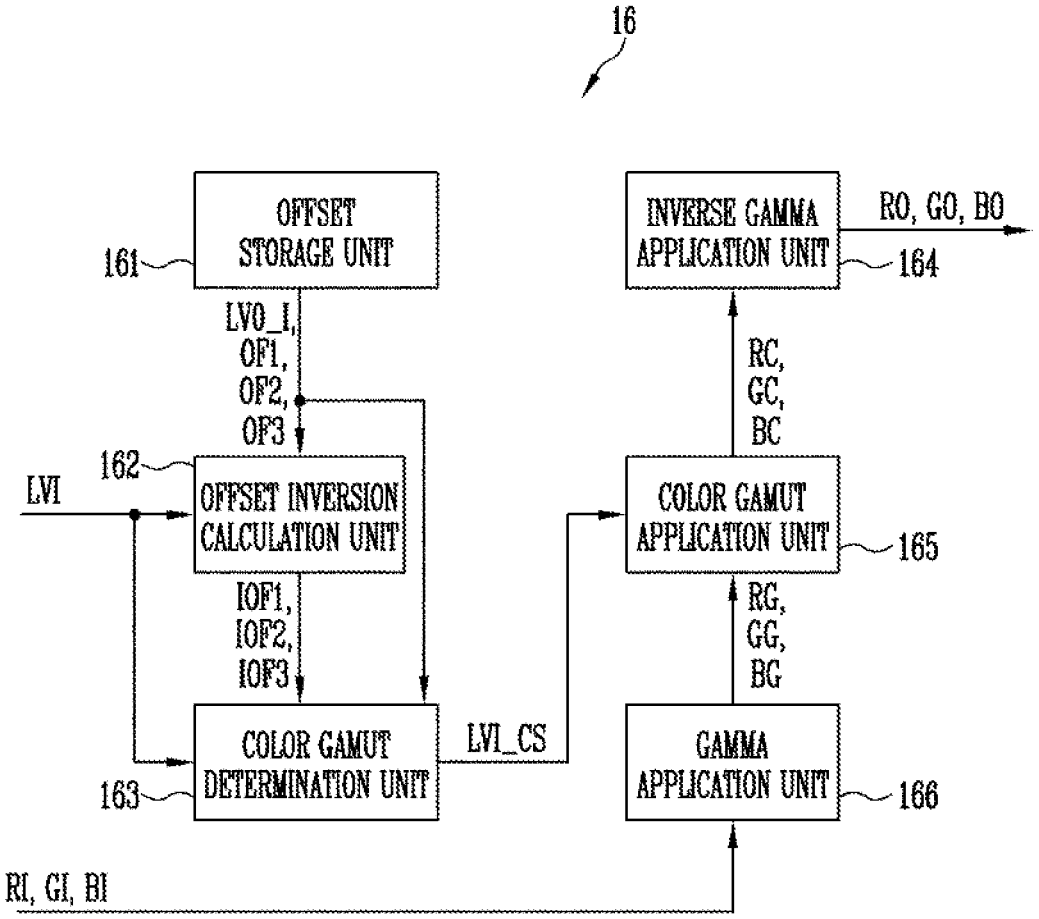
FIG. 4 is a diagram of a color shifter according to an embodiment of the invention.

FIG. 4 is a diagram of a color shifter according to an embodiment of the invention.

Referring to FIG. 4, the color shifter 16 according to an embodiment of the invention may include an offset storage unit 161, an offset inversion calculation unit 162, a color gamut determination unit 163, a gamma application unit 166, a color gamut application unit 165, and an inverse gamma application unit 164.

The color shifter 16 may convert input grayscale values RI, GI and BI into output grayscale values RO, GO and BO on the basis of output color gamut information LVI_CS determined according to a color shift level LVI.

The offset storage unit 161 may store reference color gamut information LV0_I corresponding to a reference level and first offset information OF1, OF2, and OF3 corresponding to first shift levels. In an embodiment, the first offset information OF1, OF2, and OF3 may be stored in the offset storage unit 161 before shipment of the display device 10. A process of determining the first offset information OF1, OF2, and OF3 will be described later in detail with reference to FIG. 7. In another embodiment, the first offset information OF1, OF2, and OF3 may be determined after shipment of the display device 10. For example, a user of the display device 10 may determine the first offset information OF1, OF2, and OF3 with desired values. In addition, the first offset information OF1, OF2, and OF3 may be changed through update of the display device 10. The first offset information OF1, OF2, and OF3 may be programmable.

The offset inversion calculation unit 162 may invert the first offset information OF1, OF2, and OF3 to generate second offset information IOF1, IOF2, and IOF3 when the color shift level LVI does not correspond to a value between the reference level and the first shift levels.

When the color shift level LVI corresponds to a value between the reference level and the first shift levels, the color gamut determination unit 163 may determine the output color gamut information LVI_CS using the reference color gamut information LV0_I and the first offset information OF1, OF2, and OF3. When the color shift level LVI does not correspond to a value between the reference level and the first shift levels, the color gamut determination unit 163 may determine the output color gamut information LVI_CS using the second offset information IOF1, IOF2, and IOF3 (in which the first offset information OF1, OF2, and OF3 is inverted) and the reference color gamut information LV0_I.

The gamma application unit 166 may generate gamma grayscale values RG, GG, and BG by applying a gamma curve to the input grayscale values RI, GI, and BI.

The color gamut application unit 165 may generate corrected grayscale values RC, GC, and BC by applying the output color gamut information LVI_CS to the gamma grayscale values RG, GG, and BG.

The inverse gamma application unit 164 may generate output grayscale values RO, GO, and BO by applying an inverse gamma curve to the corrected grayscale values RC, GC, and BC.

Figure 5:
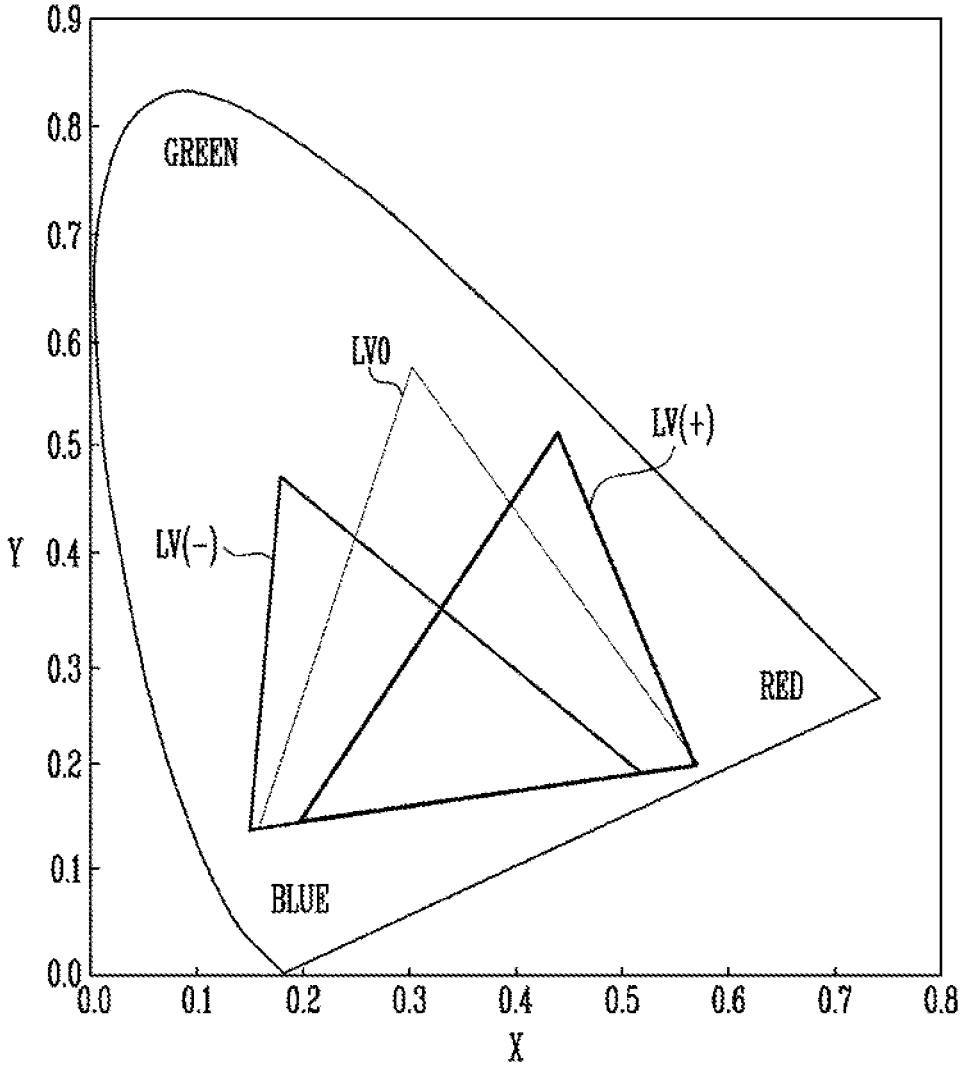
FIG. 5 is a diagram for explaining output color gamut information according to a color shift level.

FIG. 5 is a diagram for explaining output color gamut information according to a color shift level. FIG. 5 shows color ranges in a color space defined by a Commission internationale de l'éclairage (CIE) 1931 chromaticity chart. The CIE 1931 is a two-dimensional projection of a three dimensional representation of color space. Spectral colors are represented by the upper curve. A display can represent colors located within a triangle bounded by three points (the primary colors). Each triangle may be referred to as a "gamut". By adjusting the primary colors used to form the color gamut, the range of colors that may be displayed can be changed.

Referring to FIG. 5, a reference color gamut according to a reference level LV0, a first color gamut according to an arbitrary first shift level LV(+), and a second color gamut corresponding to an arbitrary second shift level LV(−) are shown.

When the reference color gamut is defined as a reference, a ratio of a blue color area of the first color gamut may be smaller than that of the reference color gamut. Therefore, when the color shift level LV1 corresponds to a value between the reference level LV0 and first shift levels LV(+), a ratio of a blue color area of the output color gamut of the output color gamut information LVI_CS may be smaller than that of the reference color gamut of the reference color gamut information LV0_I.

In addition, when the reference color gamut is defined as a reference, a ratio of a red color area of the second color gamut may be smaller than that of the reference color gamut. Therefore, when the color shift level LVI corresponds to a value between the reference level LV0 and second shift levels LV(−), the ratio of the blue color area of the output color gamut of the output color gamut information LVI_CS may be smaller than that of the reference color gamut of the reference color gamut information LV0_I.

Thus, according to an embodiment of the invention, according to a color shift level, it may be determined whether to reduce a ratio of a blue color in the color gamut or to reduce a ratio of a red color in the color gamut.

One reason for reducing the ratio of blue color in the color gamut may be related to secretion of melatonin hormone. In the evening, the secretion of melatonin hormone may be increased to help sleep. Experiments have shown that the secretion of melatonin hormone is suppressed when an image including a blue color wavelength is viewed on the display device 10. Therefore, it may be desirable to preferentially reduce the blue color wavelength which directly suppresses the secretion of melatonin hormone. In addition, the secretion of melatonin hormone may be decreased with age. Humans are known to secrete only about one third of melatonin in their sixties in comparison with melatonin secretion in their twenties. In this case, the user may further increase the secretion of melatonin hormone by setting the color shift level LVI to the first shift levels LV(+) or by setting the value between the reference level LV0 and the first shift levels LV(+) in the display device 10.

On the other hand, excessive secretion of melatonin hormone is known to cause depression. For example, a person may experience depression due to jet leg after traveling to other areas. It is a phenomenon that melatonin hormone is excessively secreted according to the time difference. In this case, the user may further reduce the secretion of melatonin hormone by setting the color shift level LVI to the second shift levels LV(−) or by setting the value between the reference level LV0 and the second shift levels LV(−) on the display device 10.

In an embodiment of the invention, the display device 10 may set the color shift level LVI with reference to age information of the user. As the user is older, the display device 10 may set the color shift level LVI to be close to a maximum level among the first shift levels LV(+). At this time, the maximum level may mean a maximum value among absolute values of the first shift levels LV(+).

In addition, as the user is younger, the display device 10 may set the color shift level LVI to be close to a maximum level among the second shift levels LV(−). At this time, the maximum level may mean a maximum value among absolute values of the second shift levels LV(−).

In another embodiment of the invention, the display device 10 may set the color shift level LVI with reference to time difference information of the user (i.e., based on how far the user has travelled). As the time difference increases, the display device 10 may set the color shift level LVI to be closer to the maximum level of the second shift levels LV(−).

Figure 6:
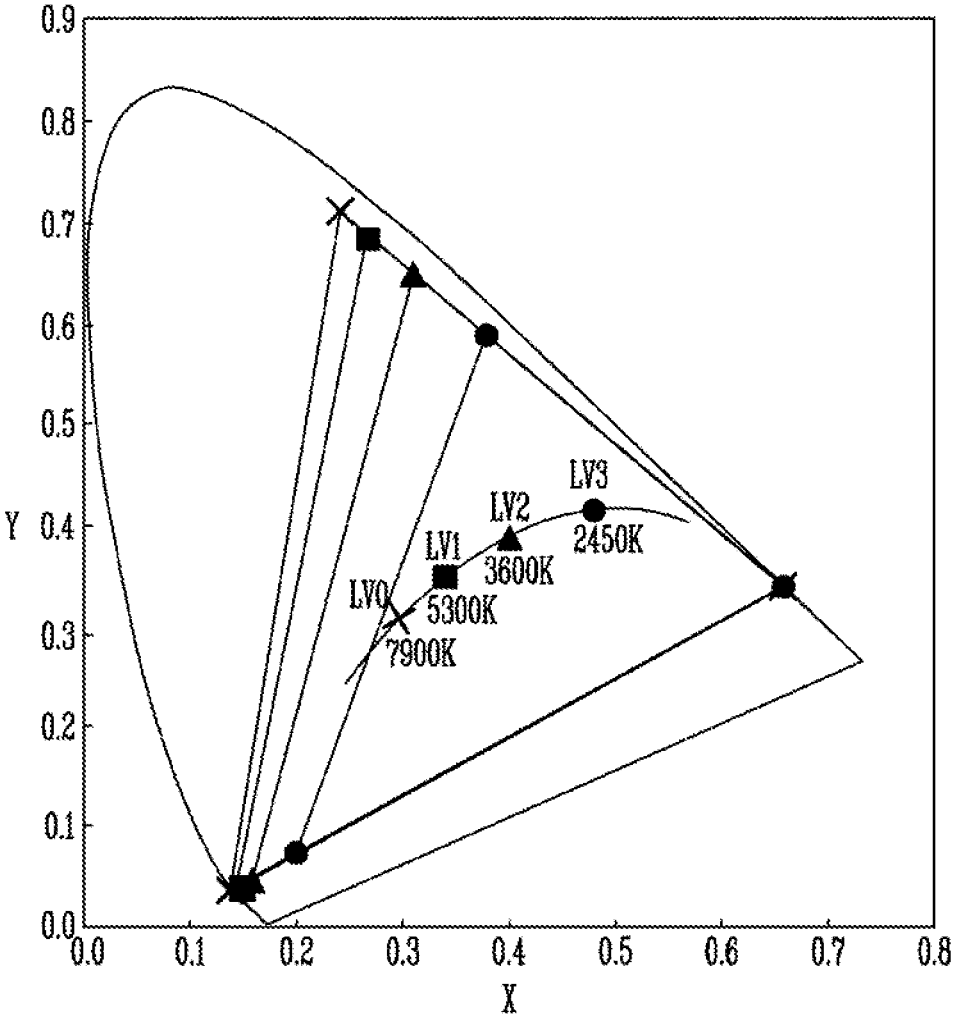

FIGS. 6 to 8 are diagrams for explaining output color gamut information when a color shift level corresponds to a value between a reference level and first shift levels.

Referring to FIG. 6, a reference color gamut (X vertices) when the color shift level LVI is the reference level LV0, a first color gamut (square vertices) when the color shift level LVI is a first level LV1, a second color gamut (triangular vertices) when the color shift level LVI is a second level LV2, and a third color gamut (circular vertices) when the color shift level LVI is a third level LV3 are exemplarily shown. The levels LV1, LV2, and LV3 may be first shift levels, and the third level LV3 may be a maximum level among the first shift levels. FIG. 6 represents the aforementioned color gamuts and shift levels according to the CIE 1931 color system described above with reference to FIG. 5. FIG. 6 also shows a color temperature curve, which represents the temperature of an ideal black-body radiator radiating a particular color of light.

For example, a color temperature of a white color grayscale of the reference color gamut may be set to 7900K when the color shift level LVI is the reference level LV0. A color temperature of a white color grayscale of the color gamut may be set to 5300K when the color shift level LVI is the first level LV1. A color temperature of a white color grayscale of the color gamut may be set to 3600K when the color shift level LVI is the second level LV2. A color temperature of a white color grayscale of the color gamut may be set to 2450K when the color shift level LVI is the third level LV3.

Referring to FIG. 7, reference color gamut information LV0_I at the reference level LV0, first level color gamut information at the first level LV1, second level color gamut information at the second level LV2, and third level color gamut information at the third level LV3 are illustrated in respective tables. The rows in each level correspond to levels of red, green, and blue light used to represent reference colors of red, green, blue, cyan, magenta, yellow, and white. As an example, with a high level of offset, it should be noted that the level of blue light in the representation of the color white is less than the level of blue light according to the reference color gamut. Thus, with a high offset, the color shifted gamut with the reduced level of blue light may not inhibit the production of melatonin as much as the reference color gamut.

The first offset information OF1 may correspond to a difference value between the first level color gamut information and the reference color gamut information. The first offset information OF2 may correspond to a difference value between the second level color gamut information and the first level color gamut information. The first offset information OF3 may correspond to a difference value between the third level color gamut information and the second level color gamut information.

The offset storage unit 161 may store the reference color gamut information LV0_I corresponding to the reference level LV0 and the first offset information OF1, OF2 and OF3 corresponding to the first shift levels. For example, the offset storage unit 161 may be constituted by a memory device such as a register. Since the offset storage unit 161 does not need to store the first level color gamut information, the second level color gamut information, and the third level color gamut information that require more bits than the first offset information OF1, OF2, and OF3, the hardware configuration cost can be reduced.

When the color shift level LVI corresponds to the value between the reference level LV0 and the first shift levels LV1, LV2 and LV3, the color gamut determination unit 163 may determine the output color gamut information LVI_CS using the reference color gamut information LV0_I and the first offset information OF1, OF2, and OF3.

For example, the color shift level corresponding to the reference level LV0 may be 0, and the color shirt levels corresponding to the first shift levels LV1, LV2, and LV3 may be 102, 178, and 255, respectively.

When the color shift level LVI inputted from an external processor is 50, the color gamut determination unit 163 may determine offset interpolation information using the reference color gamut information LV0_I and the first offset information OF1 according to following Equation 1:

$$OFI \times \text{round}((OF1_I/LV1_V)*LVI) \quad \text{[Equation 1]}$$

where OFI is offset interpolation information, OF1_I is first offset information OF1, LV1_V is a color shirt level of a first level, LVI is a color shirt level LVI inputted, and round( ) may be a rounding function.

Referring to FIG. 8, when the LV1_V is 102 and the LVI is 50, offset interpolation information OFI_R, OFI_G, OFI_B, OFI_C, OFI_M, OFI_Y, and OFI_W calculated by the equation 1 is exemplarily shown. For example, for the first row we have:

$$OFI_R=\text{round}(([-19,0,0]/102)*50)=[-9,0,0] \quad \text{[Equation 1.1]}$$

The output color gamut information LVI_CS may be determined by adding the offset interpolation information OFI_R to OFI_W to the reference color gamut information LV0_R, LV0_G, LV0_B, LV0_C, LV0_M, LV0_Y and LV0_W.

The output color gamut information LVI_CS may include red color grayscale information LVI_R, green color grayscale information LVI_G, blue color grayscale information LVI_B, cyan color grayscale information LVI_C, magenta color grayscale information LVI_M, yellow color grayscale information LVI_Y, and white color grayscale information LVI_W. In grayscale information, a first column may mean a red color grayscale value, a second column may mean a green color grayscale value, and a third column may mean a blue color grayscale value.

When the color shift level LVI inputted from an external processor is a value between 102 and 178, the color gamut determination unit 163 may determine the offset interpolation information using the first offset information OF1 and OF2 according to following Equation 2:

$$OFI=\text{round}((OF2_I/(LV2_V-LV1_V)*(LVI-LV1_V))+OF1_I \quad \text{[Equation 2]}$$

where OFI is offset interpolation information, OF1_I is first offset information OF1, OF2_I is first offset information OF2, LV1_V is a color shift level of a first level, LV2_V is a color shift level of a second level, LVI is a color shift level LVI inputted, and round( ) may be a rounding function.

When the color shift level LVI inputted from an external processor is a value between 178 and 255, the color gamut determination unit 163 may determine the offset interpolation information using the first offset information OF1, OF2, and OF3 according to following Equation 3:

$$OFI=\text{round}((OF3_I/(LV3_V-LV2_V)*(LVI-LV2_V))+OF1_I+OF2_I \quad \text{[Equation 3]}$$

where OFI is offset interpolation information, OF1_I is first offset information OF1, OF2_I is first offset information OF2, OF3_I is first offset information OF3, LV2_V is a color shift level of a second level, LV3_V is a color shift level of a third level, LVI is a color shift level LVI inputted, and round( ) may be a rounding function.

Figures 10, 11:
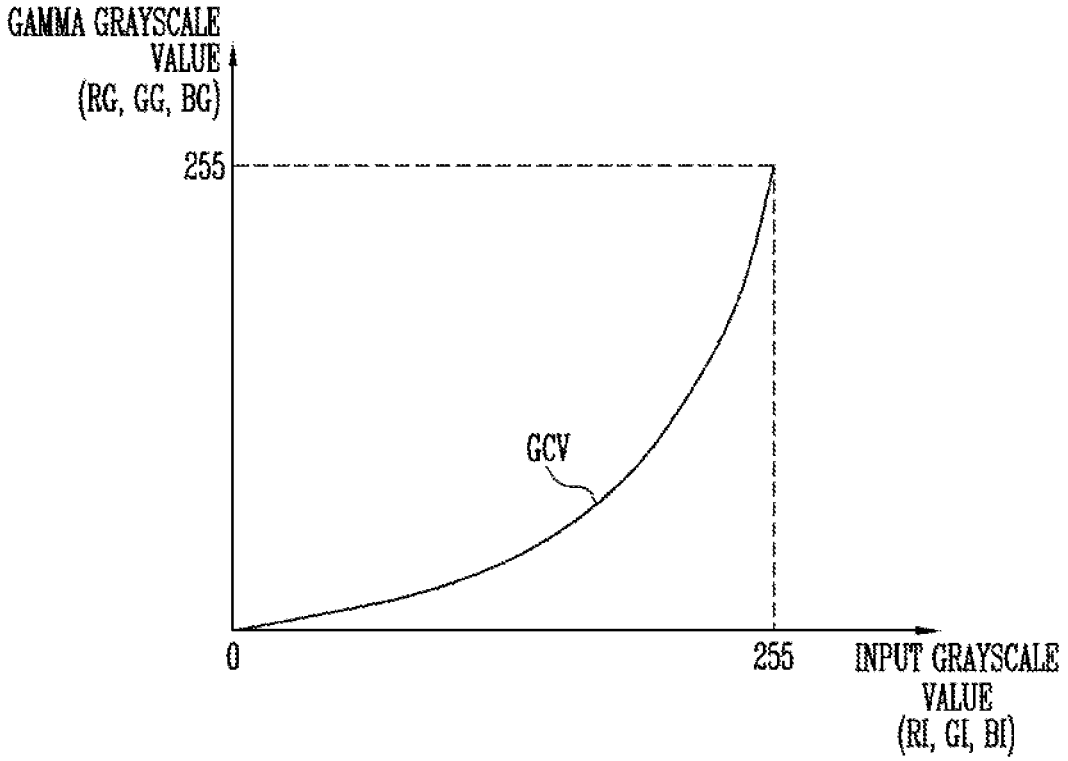

FIGS. 9 and 10 are diagrams for explaining output color gamut information when a color shift level corresponds to a value between a reference level and second shift levels. For example, the output color gamut according to FIGS. 9 and 10 may represent a color shift that results in less red light (or relatively more blue light), which may be useful in improving the mood of the user.

When the color shift level LVI is not between the reference level and the first shift levels LV1, LV2 and LV3, the offset inversion calculation unit 162 may invert the first offset information OF1, OF2, and OF3 to generate the second offset information IOF1, IOF2, and IOF3. For example, the second offset information IOF1 may include grayscale values obtained by inverting the signs of the grayscale values included in the first offset information OF1. Similarly, the second offset information IOF2 may include grayscale values obtained by inverting the signs of the grayscale values included in the first offset information OF2. The second offset information IOF3 may include grayscale values obtained by inverting the signs of the grayscale values included in the first offset information OF3.

The second shift level of the second offset information IOF1 may correspond to an inversion value of the first shift level LV1 of the first offset information OF1. For example, when the first shift level LV1 of the first offset information OF1 is 102, the second shift level of the second offset information IOF1 may be −102. Similarly, the second shift level of the second offset information IOF2 may be −178 and the second shift level of the second offset information IOF3 may be −255.

Therefore, the display device 10 of the embodiment does not require a memory device for storing the second offset information IOF1, IOF2, and IOF3, so that the hardware configuration cost can be reduced.

When the color shift level LVI is not between the reference level and the first shift levels LV1, LV2 and LV3 (e.g., when the color shift level is negative), the color gamut determination unit 163 may determine the output color gamut information LVI_CS using the second offset information IOF1, IOF2, and IOF3 in which the first offset information OF1, OF2, and OF3 is inverted and the reference color gamut information LV0_I.

For example, when the color shift level LVI inputted is less than 0 and greater than −255, the color gamut determination unit 163 may determine the output color gamut information LVI_CS using the second offset information IOF1, IOF2, and IOF3 and the reference color gamut information LV0_I.

Referring to FIG. 10, offset interpolation information IOFI_R, IOFI_G, IOFI_B, IOFI_C, IOFI_M, IOFI_Y, and IOFI_W, which is illustratively calculated, is shown when the color shift level LVI inputted is −50. Exemplary equations may be similar to the equations 1, 2, and 3, so redundant explanations are omitted.

The output color gamut information LVI_CS may be determined by adding the offset interpolation information IOFI_R to IOFI_W to the reference color gamut information LV0_R to LV0_W.

FIG. 11 is a graph for explaining a gamma application unit according to an embodiment of the invention.

The gamma application unit 166 may generate gamma grayscale values RG, GG, and BG by applying a gamma curve GCV to the input grayscale values RI, GI, and BI.

A gamma value of the gamma curve GCV, e.g., gamma 2.0, gamma 2.2, or gamma 2.4, may vary depending on the display device 10. In addition, according to embodiments, a user may set the gamma value of the gamma curve GCV.

Since an image frame reflecting the gamma curve GCV is displayed to the user, it is preferable to apply the output color gamut information LV1_CS based on the gamma grayscale values RG, GG, and BG reflecting the gamma curve GCV.

Figure 12:
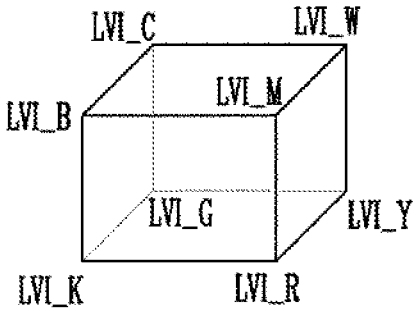
FIG. 12 is a diagram of a color gamut application unit according to an embodiment of the invention.

FIG. 12 is a diagram of a color gamut application unit according to an embodiment of the invention.

The color gamut application unit 165 may generate the corrected grayscale values RC, GC, and BC by applying the output color gamut information LVI_CS to the gamma grayscale values RG, GG, and BG.

As described above, the output color gamut information LVI_CS may include the red color grayscale information LVI_R, the green color grayscale information LVI_G, the blue color grayscale information LVI_B, the cyan color grayscale information LVI_C, the magenta color grayscale information LVI_M, the yellow color grayscale information LVI_Y, and the white color grayscale information LVI_W.

In addition, the output color gamut information LVI_CS may further include black color grayscale information LVI_K. In general, a red color grayscale value, a green color grayscale value, and a blue color grayscale value of the black color grayscale information LVI_K may all be set to 0. According to embodiments, grayscale values of the black color grayscale information LVI_K may be set to values other than C.

The color gamut application unit 165 may generate the corrected grayscale values RC, GC, and BC within a range of the output color gamut information LVI_CS. For a more intuitive understanding, FIG. 12 shows a cube composed of three coordinate axes LVI_R, LVI_G and LVI_B, which are orthogonal to each other with the origin of the black color grayscale information LVI_K. The corners of the cube correspond to color grayscale information for the colors black, green yellow, red (on the bottom) and blue, cyan, white, and magenta (on the top).

The corrected grayscale values RC, GC, and BC may be calculated through a table shown in FIG. 12 and the following exemplary equations 4, 5, and 6.

$$RC=LVI_K_R+C1_R*RG/r_step+C2_R*GG/g_step+C3_R*BG/b_step \quad \text{[Equation 4]}$$

$$GC=LVI_K_G+C1_G*RG/r_step+C2_G*GG/g_step+C3_G*BG/b_step \quad \text{[Equation 5]}$$

$$BC=LVI_K_B+C1_B*RG/r_step+C2_B*GG/g_step+C3_B*BG/b_step \quad \text{[Equation 6]}$$

where LVI_K_R is a red color grayscale value of black color grayscale information LVI_K, LVI_K_G is a green color grayscale value of black color grayscale information LVI_K, LVI_K_B is a blue color grayscale value of black color grayscale information LVI_K, C1_R is a red color grayscale value of C1 calculated according to the table, C1_G is a green color grayscale value of C1 calculated according to the table. C1_B is a blue color grayscale value of C1 calculated according to the table, C2_R is a red color grayscale value of C2 calculated according to the table, C2_G is a green color grayscale value of C2 calculated according to the table, C2_B is a blue color grayscale value of C2 calculated according to the table, C3_R is a red color grayscale value of C3 calculated according to the table, C3_G is a green color grayscale value of C3 calculated according to the table, and C3_B is a blue color grayscale value of C3 calculated according to the table. In addition, r_step, g_step, and b_step may be constants. For example, r_step, g_step, and b_step may be 128.

Figure 13:
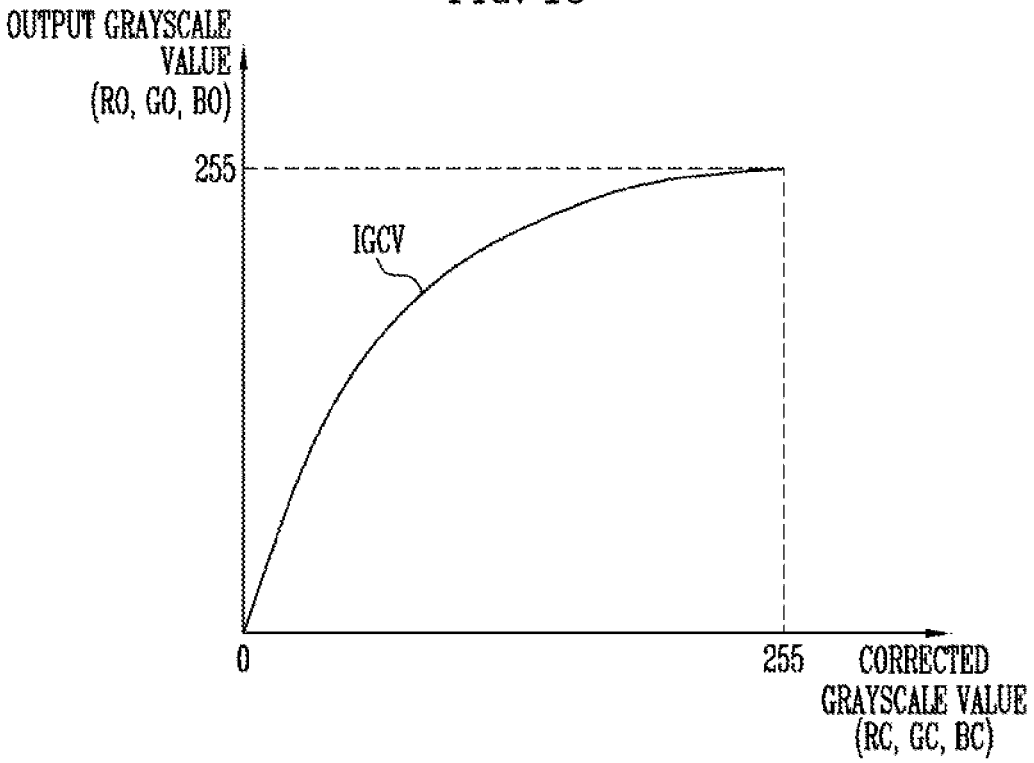
FIG. 13 is a graph for explaining an inverse gamma application unit according to an embodiment of the invention.

FIG. 13 is a graph for explaining an inverse gamma application unit according to an embodiment of the invention.

The inverse gamma application unit 164 may generate the output grayscale values RO, GO, and BO by applying an inverse gamma curve IGCV to the corrected grayscale values RC, GC, and BC.

Since the data driver 12 may generate data signals using gamma voltages that reflect gamma values, it is necessary to prevent the gamma values from being reflected twice. Therefore, the inverse gamma application unit 164 may generate the output grayscale values RO, GO, and BO by applying the inverse gamma curve IGCV to the corrected grayscale values RC, GC, and BC.

An inverse gamma value of the inverse gamma curve IGCV may be an inverse number of the gamma value of the gamma curve GCV in FIG. 11.

The display device and the driving method thereof according to the invention may control the color gamut using minimum information.

The drawings referred to heretofore and the detailed description of the invention described above are merely illustrative of the invention. It is to be understood that the invention has been disclosed for illustrative purposes only and is not intended to limit the scope of the invention. Therefore, those skilled in the art will appreciate that various modifications and equivalent embodiments are possible without departing from the scope of the invention. Accordingly, the true scope of the invention should be determined by the technical idea of the appended claims.

What is claimed is:

1. A display device comprising:

a pixel emitting light at a luminance corresponding to an output grayscale value; and a color shifter for converting an input grayscale value into the output grayscale value based on output color gamut information determined according to a color shift level, wherein the color shifter includes:

an offset storage unit in which reference color gamut information corresponding to a reference level and first offset information corresponding to first shift levels are stored; and a color gamut determination unit that determines the output color gamut information using the reference color gamut information and the first offset information when the color shift level corresponds to a value between the reference level and the first shift levels, and determines the output color gamut information using second offset information, in which the first offset information is inverted, and the reference color gamut information when the color shift level is not between the reference level and the first shift levels.

2. The display device of claim 1, wherein the color shifter further includes an offset inversion calculation unit for inverting the first offset information to generate the second offset information when the color shift level is not between the reference level and the first shift levels.

3. The display device of claim 2, wherein the color shifter further includes a gamma application unit for applying a gamma curve to the input grayscale value to generate a gamma grayscale value.

4. The display device of claim 3, wherein the color shifter further includes a color gamut application unit for applying the output color gamut information to the gamma grayscale value to generate a corrected grayscale value.

5. The display device of claim 4, wherein the color shifter further includes an inverse gamma application unit for applying an inverse gamma curve to the corrected grayscale value to generate the output grayscale value.

6. The display device of claim 1, wherein when the color shift level corresponds to the value between the reference level and the first shift levels, a ratio of a blue color area of an output color gamut of the output color gamut information is smaller than that of a reference color gamut of the reference color gamut information.

7. The display device of claim 6, wherein when the color shift level corresponds to a value between the reference level and second shift levels, a ratio of a red color area of the output color gamut of the output color gamut information is smaller than that of the reference color gamut of the reference color gamut information.

8. A driving method of a display device, the method comprising:

determining output color gamut information according to a color shift level;

converting an input grayscale value into an output grayscale value based on the output color gamut information; and emitting, by a pixel, light at a luminance corresponding to the output grayscale value.

wherein the determining the output color gamut information comprises:

determining the output color gamut information using reference color gamut information corresponding to a reference level and first offset information corresponding to first shift levels when the color shift level corresponds to a value between the reference level and the first shift levels, and determining the output color gamut information using second offset information in which the first offset information is inverted and the reference color gamut information when the color shift level is not between the reference level and the first shift levels.

9. The method of claim 8, wherein the reference color gamut information and the first offset information are stored values, and wherein the determining the output color gamut information comprises:

generating the second offset information by inverting the first offset information when the color shift level is not between the reference level and the first shift levels.

10. The method of claim 9, wherein the converting the input grayscale value into the output grayscale value comprises:

generating a gamma grayscale value by applying a gamma curve to the input grayscale value.

11. The method of claim 10, wherein the converting the input grayscale value into the output grayscale value further comprises:

generating a corrected grayscale value by applying the output color gamut information to the gamma grayscale value.

12. The method of claim 11, wherein the converting the input grayscale value into the output grayscale value further comprises:

generating the output grayscale value by applying an inverse gamma curve to the corrected grayscale value.

13. The method of claim 8, wherein when the color shift level corresponds to the value between the reference level and the first shift levels, a ratio of a blue color area of an output color gamut of the output color gamut information is smaller than that of a reference color gamut of the reference color gamut information.

14. The method of claim 13, wherein when the color shift level corresponds to a value between the reference level and second shift levels, a ratio of a red color area of the output color gamut of the output color gamut information is smaller than that of the reference color gamut of the reference color gamut information.

15. A method of driving a display device, the method comprising:

determining whether a color shift level has a negative value;

select first offset information or inverted first offset information based on the determination;

generate output color gamut information based on the selected first offset information or inverted first offset information;

convert an input grayscale value to an output grayscale value based on the generated output color gamut information; and emit light at a pixel based on the output grayscale value.

* * * * *